United States Patent [19]

Breisch et al.

[11] 3,981,229

[45] Sept. 21, 1976

[54] GAS POWERED MOTOR

[75] Inventors: John H. Breisch, Lakewood, Ohio; William L. Brown, 4th, Pine Grove Mills, Pa.

[73] Assignee: Midland-Ross Corporation, Cleveland, Ohio

[22] Filed: June 27, 1974

[21] Appl. No.: 483,575

Related U.S. Application Data

[60] Continuation-in-part of Ser. No. 378,334, July 11, 1973, abandoned, which is a division of Ser. No. 173,832, Aug. 23, 1971, abandoned.

[52] U.S. Cl. ..... 92/72; 92/187; 92/240; 74/579 E; 74/580; 60/625

[51] Int. Cl.[2] ..... F01B 1/00; F02N 7/02

[58] Field of Search ..... 123/55 A, 55 R; 403/331, 150, 152, 119; 92/72, 187, 240; 74/579 E, 580; 60/625

[56] References Cited

UNITED STATES PATENTS

| | | | |
|---|---|---|---|
| 938,146 | 10/1909 | Hibbard | 92/72 X |
| 1,316,834 | 9/1919 | Poschadel | 74/580 |
| 2,313,271 | 3/1943 | Schnell | 92/240 |
| 2,533,558 | 12/1950 | Chilton | 92/72 X |
| 3,388,638 | 6/1968 | Brinkel | 92/240 X |
| 3,465,952 | 9/1969 | Smith et al. | 92/187 X |
| 3,802,323 | 4/1974 | Suechting | 92/249 X |

FOREIGN PATENTS OR APPLICATIONS

| | | | |
|---|---|---|---|
| 630,931 | 10/1934 | Germany | 74/580 |

*Primary Examiner*—Allen M. Ostrager
*Attorney, Agent, or Firm*—Bosworth, Sessions & McCoy

[57] ABSTRACT

A radial motor powered by pressurized gas is disclosed as used for starting the internal combustion engine of a portable implement such as a powered chain saw or lawn mower. The motor is designed for economical manufacture and assembly, durability, and economy of gas used. It includes pistons formed of stiff resilient material that in assembly are snapped onto the outer ends of connecting rods and held in place during operation of the motor without the use of retaining rings, pivot pins or screws. The inner ends of these connecting rods are held in sockets in connecting rod mounting means either by the shapes of the sockets or by the resilience of either or both of the connecting rod and mounting means. The motor includes a rotatable valve driven by a free end of the crankshaft to feed gas to the cylinders. The motor can be assembled from either or both sides through openings in the cylinder block, and the pistons can be snapped on the connecting rods through the ends of the cylinders, which are thereafter closed. Also disclosed is a gas supply system embodying a control valve and a plenum chamber which is charged from a suitable source to provide only a predetermined amount of pressurized gas for starting the engine. Plenum chambers are disclosed embodying means for varying the gas volume and for heating the gas to improve power gas use economy.

10 Claims, 28 Drawing Figures

FIG. 11
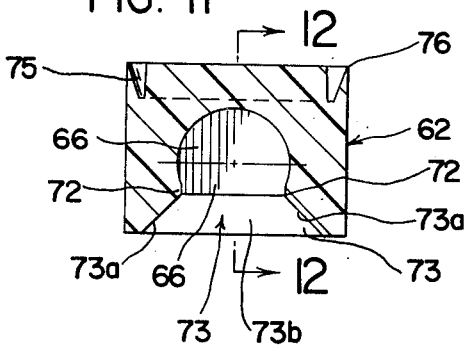
FIG. 12
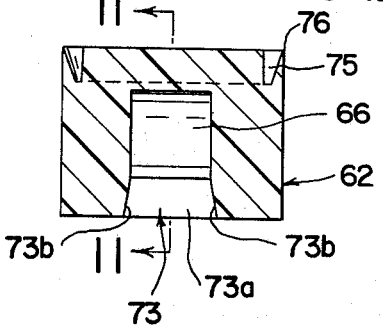
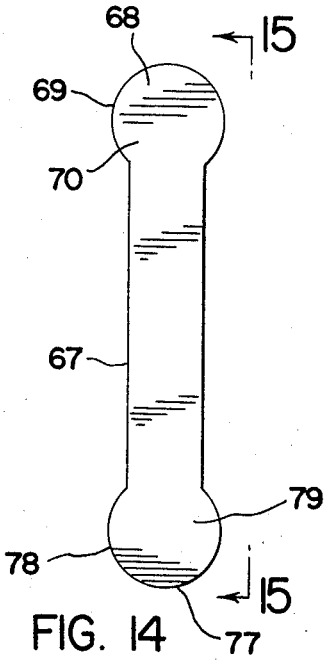
FIG. 14
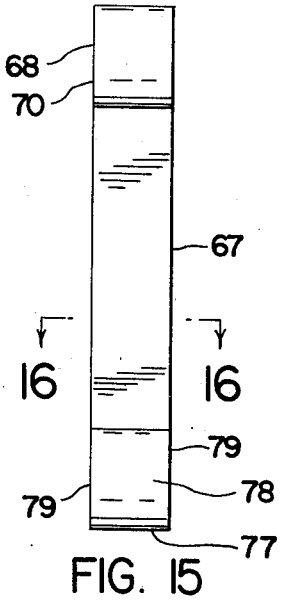
FIG. 15
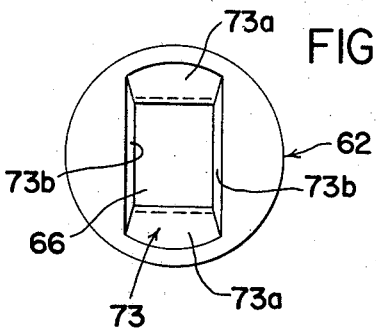
FIG. 13
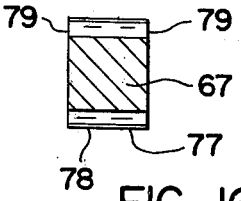
FIG. 16

FIG. 23
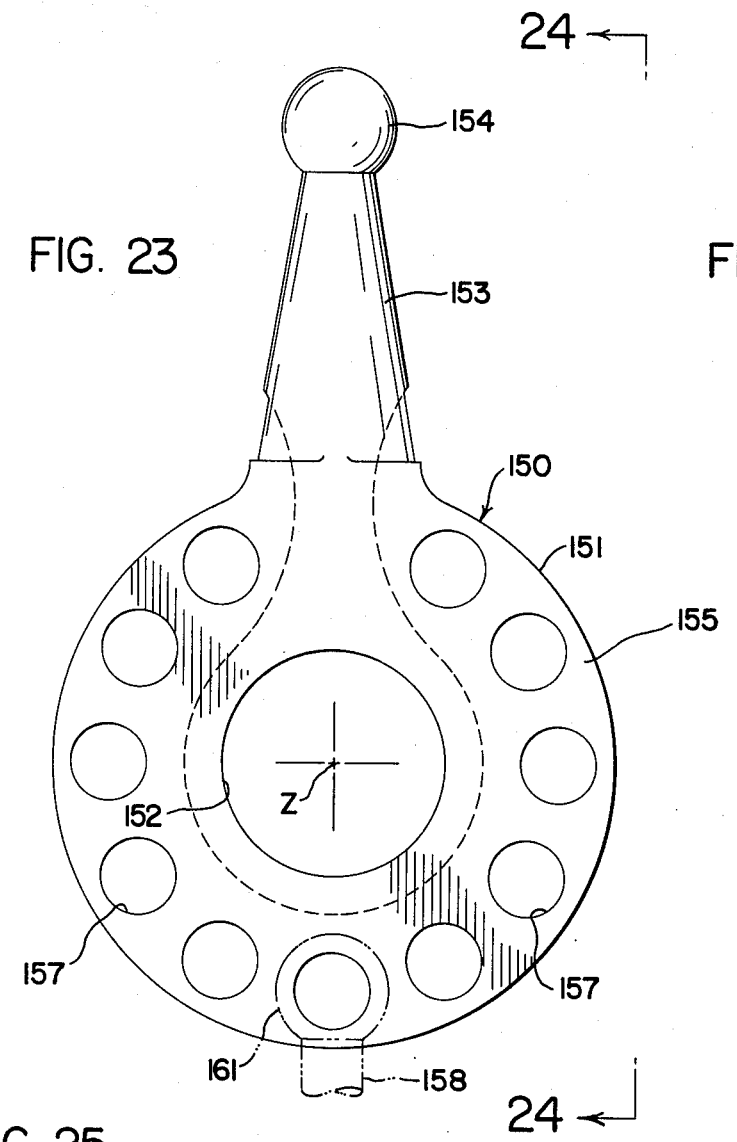
FIG. 24
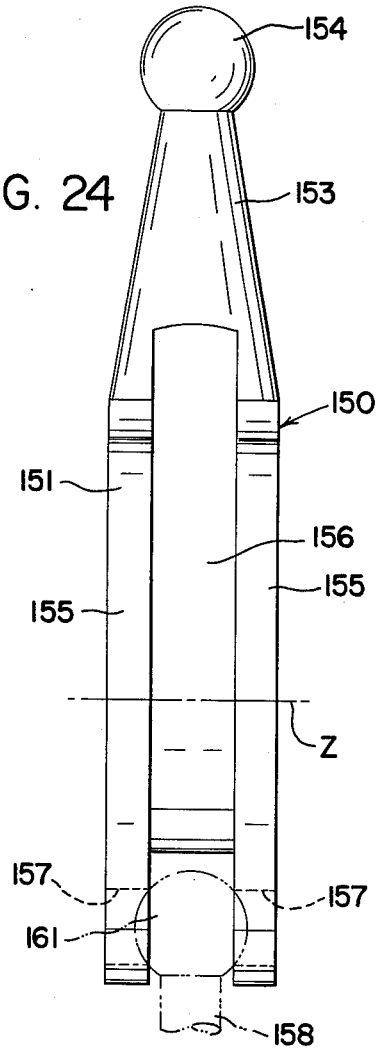
FIG. 25
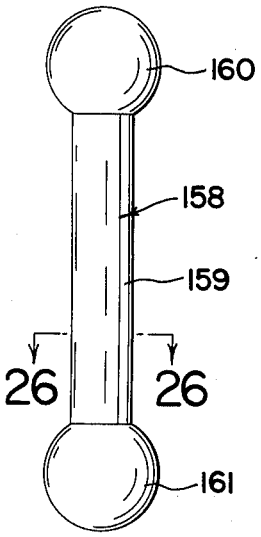
FIG. 26
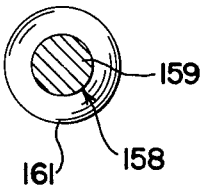
FIG. 27
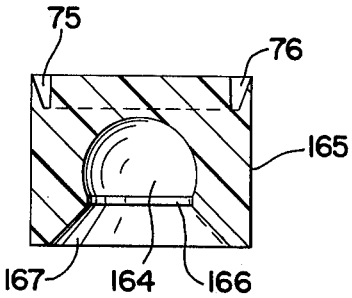
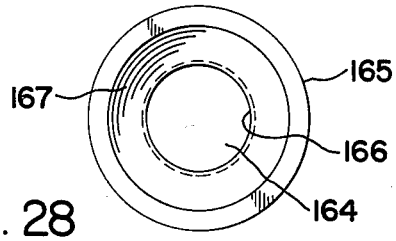
FIG. 28

GAS POWERED MOTOR

CROSS REFERENCE TO RELATED APPLICATIONS

This application is a continuation-in-part of application Ser. No. 378,334 now abandoned filed July 11, 1973, which is a division of application Ser. No. 173,832 now abandoned Aug. 23, filed Aug. both filed in the names of William L. Brown 4th and John H. Breisch.

BACKGROUND OF THE INVENTION

This invention relates to gas-powered motors, and more particularly gas-powered motors that are driven by suitable pressurized power gas supplied from a suitable source, such as a tank or other container of liquified carbon dioxide gas.

The invention is particularly advantageous in the provision of a gas-powered starter motor and power gas control system, for starting an internal combustion engine, and particularly a small internal combustion engine of a portable chain saw or of a power lawn mower or other movable or portable implement embodying such an internal combustion engine.

DESCRIPTION OF PRIOR ART

A considerable need exists for a safe, economical means of starting small internal combustion engines of implements such as chain saws or lawn mowers powered by such engines. At the present time, except for those internal combustion engines which are provided with electric starting equipment necessitating the use of a battery or cable that is connectible to a source of electricity, the internal combustion engine of essentially all such implements is started by manually pulling a cord, or by cranking up a coil spring to tension it and then releasing the spring.

Electric starting means is expensive; and if battery operated it requires the use and transportation of a heavy expensive battery that requires time-consuming recharging, and if powered through an electrical cable from a source of electricity it is often inconvenient to use since the implement cannot be started if it is not close to the source.

Starting means employing a manually pulled cord provides numerous disadvantages. Pulling the cord involves considerable manual effort, which often is beyond the strength of women or young people. Moreover, pulling on the cord with a necessarily short stroke within the capabilities of the human arm, often does not rotate the internal combustion engine sufficiently to start it without repeated pulls, particularly if the engine is cold. The necessity of pulling the cord while holding the implement stationary also often introduces substantial possibilities of danger, particularly if the equipment is a chain saw or rotary lawn mower that could cause serious injury if it slips or moves during the starting operation. Moreover, the cord is subject to wear and breakage; if the cord is permanently attached to the starter, its replacement involves time-consuming and expensive repair job; if the cord is not permanently affixed to the starting means, the starting operation involves the inconvenient and time-consuming necessity of connecting the cord to a rotary winch on the shaft of the internal combustion engine and pulling the cord for each attempt to start.

If a spring type starter is used, there is the possibility that the spring may break, with possible danger to the operator, and in any event an expensive and time-consuming repair job is required. Moreover, spring type starters require considerable time and effort to wind up the spring and release it for starting the engine; since the spring can rotate the engine for only a few turns, the engine often does not start when cold without repeated winding of the spring, which involves greatly increased expenditure of time and effort.

SUMMARY OF THE INVENTION

One of the effects of the present invention is to provide a starter motor that is free of these and other disadvantages and shortcomings of prior starting means.

Another object is to provide a motor adapted to be powered by pressurized gas, which motor may be of inexpensive and durable construction.

A further object is the provision of apparatus embodying a gas-powered motor and means to supply to it a predetermined amount of pressurized gas to operate it, as to operate it sufficiently to start an internal combustion engine.

A further object is the provision of a gas powered motor having associated with it means to supply it with a predetermined amount of pressurized gas to operate it, which amounts of pressurized gas can be varied according to whether the motor is to be used to start a cold internal combustion engine or one that has been warmed by a previous operation.

Another object is the provision of a gas powered motor associated with means to supply to it a predetermined amount of pressurized gas that can be heated to increase its volume.

The invention provides a motor to be powered by pressurized gas comprising housing means having an axis and a plurality of cylinders disposed generally radially around the axis, and means providing two openings in the sides of the housing between the cylinders which openings are spaced along the axis, one of the openings having a surface that is concentric with the axis. The motor comprises conduit means extending from each of the cylinders to a port in the concentric surface, a valve member rotatably mounted on the housing means in essentially gas-tight relation with the concentric surface and having a gas feeding opening adapted to communicate with and feed pressurized gas to each of the ports as the valve member rotates, a supporting member mounted on the housing means at the opening at the side of the housing means opposite that in which the valve member is located, a crankshaft having a shaft portion that is mounted in the supporting member of rotation about the axis of the housing means and a crank pin portion offset from the axis having a free end that directly engages the rotatable valve member and rotates it as the crankshaft rotates, a piston slidably mounted in each of the cylinders for movement toward and away from the axis of the housing means, connecting rod means mounted on the offset crank pin portion of the crankshaft and connected to each of the pistons, and closure means fixed to the housing means and enclosing the rotatable valve member, the closure means providing communication with a source of pressurized gas and with the opening in the valve means, adapted to cause the pressurized gas to exert force on the valve member that aids in locating it axially of the housing means.

The invention also provides a motor to be powered by pressurized gas comprising housing means having an axis and a plurality of cylinders generally radially around the axis, crank means having a shaft portion supported from the housing means for rotation around the axis and having a crank pin portion offset from the axis of the housing means, pistons mounted in the cylinders, the pistons being formed of stiff, resilient material, each of the pistons having a socket opening therein, connecting rod mounting means rotatably mounted on the crank pin portion, the connecting rod mounting means having a plurality of openings therein corresponding to a plurality of the cylinders, a plurality of connecting rods each having a first end portion that is held in a socket of one of the pistons, this end portion and the piston socket being shaped so that due to resilience of the material of which the piston is formed, the first end portion of the connecting rod may be snapped into the socket and thereafter pivotally but firmly held in the socket during operation of the engine, the connecting rod also having at its other end a second portion pivotally but firmly connected to the connecting rod mounting means solely by the shape of the second portion and of at least one of the openings in the connecting rod mounting means without the use of a pivot pin or the like.

The invention also provides a pressurized power gas control system compressing a valve operable to introduce a limited charge of pressurized gas into a plenum chamber from a source of such gas, to disconnect the chamber from the source, and then to connect the chamber to the motor to operate it with the charge of gas.

The invention also comprises a variable volume plenum chamber and a plenum chamber that can heat the gas.

These and other objects, advantages and features of the invention will become apparent from the following description of the preferred embodiments of the invention in connection with the following drawings.

BRIEF DESCRIPTION OF THE DRAWINGS

FIG. 11 is a cross section, to a larger scale than that of FIG. 4, through one of the pistons of the engine of FIGS. 1 to 10 inclusive, the view taken along line 11—11 of FIG. 12;

FIG. 12 is a cross section of the same piston, along line 12—12 of FIG. 11;

FIG. 13 is a view from the bottom of the piston as shown in FIGS. 11 and 12, showing the shape of the socket that receives the end of the connecting rod, and of the recess at the entrance to the socket;

FIG. 14 is a side elevation of one of the individual connecting rods adapted to be pivotally connected between the piston and the connecting rod mounting means;

FIG. 15 is a view of the connecting rod from line 15—15 of FIG. 14;

FIG. 16 is a section along line 16—16 of FIG. 15;

FIG. 23 is a view to a scale approximately that of FIGS. 11 to 16 inclusive, of the master connecting rod member of a different embodiment of the invention having a spherical and which is adapted to be snapped into a socket in the pistons;

FIG. 24 is a view from line 24—24 of FIG. 23;

FIG. 25 is a view to the same scale as FIGS. 11 to 16 inclusive, of a different embodiment of individual connecting rod, this one having portions of spheres of both ends, and adapted to be used with the master connecting rod of FIGS. 23 and 24 and the piston of FIGS. 27 and 28;

FIG. 26 is a section along line 26—26 of FIG. 25;

FIG. 27 is a different embodiment of the piston from that of FIGS. 7 to 12 inclusive, having a spherical socket in which an end of the connecting rod of FIGS. 23 and 24 may be held;

FIG. 28 is a bottom view of the piston of FIG. 27.

DESCRIPTION OF THE PREFERRED EMBODIMENTS

Figure 1:
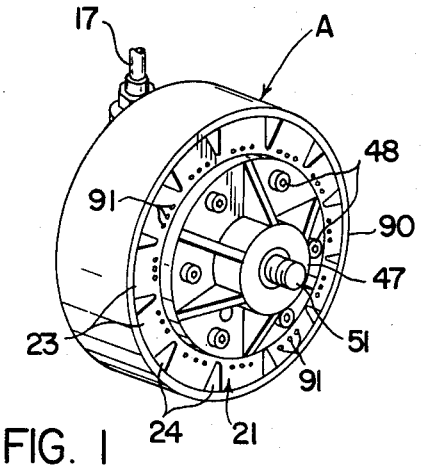
FIG. 1 is an isometric external view, to a small scale, of an engine embodying the invention.

As shown in FIGS. 1 to 4 inclusive, a gas powered motor A embodying the invention is mounted on the frame of an otherwise conventional portable chain saw B adapted to rotate for starting through a conventional one-way clutch C, and internal combustion engine D that when started drives the chain E of the saw in a conventional manner.

Motor A (FIGS. 2, 17, 18) is powered by pressurized gas supplied from a suitable source 11 which source takes the form in this embodiment of a commercially available tank of liquified carbon dioxide gas mounted on the frame of the chain saw. A tube 12 connects tank 11 with a control valve unit 13 that is connected by tubes 14 and 15 to a plenum chamber 16. Tube 17 connects valve unit 13 with motor A. As described in more detail later, by manipulation of valve unit 13, the plenum chamber can be first charged with a predetermined minimal amount of pressurized gas, which amount can then be used to operate motor A to start internal combustion engine D.

Motor A (FIGS. 3–7) comprises a cylinder block 21 circular about an axis X and embodying identical radial cylinders 22 of circular cross section, preferably equidistantly and equiangularly arranged around axis X. The cylinders have axes Y that preferably lie in the same plane normal to axis X. The cylinders extend to the circular periphery of the cylinder block in cylinder portions 23, which are separated by spaces 24 for weight saving and economy of material. The cylinder block includes a plurality of generally radial inlet conduits 25, one for each cylinder, each terminating in a transverse conduit 26 opening into the outermost end of one of the cylinders 22.

The inner end of each conduit 25 terminates in a port 27 in an axially extending inner circular surface 28 concentric about axis X. A radially extending surface 29 concentric about axis X and facing outwardly and away from the cylinders, joins the surface 28 to define an opening 30, concentric about axis X, at the side of the cylinder block.

A rotatable valve member 31 concentric about axis X has concentric axial and radial outer surfaces 32 and 33 rotatably fitting substantially gas-tight against axial and radial inner surfaces 28 and 29 of opening 30. Member 31 has a generally radial conduit 34 having an outlet port 35 shown as angularly wide enough to communicate simultaneously with pairs of ports 27 in sequence. However, port 35 may extend in an angular direction to communicate with only one, or more than two, ports 27 so as to feed gas to a desired number of cylinders at a time.

Conduit 34 opens into a central recess 36 in valve member 31, which recess fits over a hub portion 37 of a closure member 38 having an axial concentric ridge 39 that fits tightly against axial surface 28 and against a radial outer surface on the cylinder block, and is demountably held in place by bolts 40 extending through member 38 and threaded into the cylinder block. Suitable sealing means, such as O-ring 41 in annular groove 42 in hub 37 of member 38, seals rotatable valve member 32 gas-tight to the hub member. Closure member 38 has a gas inlet passage 43 one end of which opens through hub 37 into the central recess 36 of the valve member 32, and the other end of which is connected to tube 17 supplied with pressurized gas.

The other side of the cylinder block has another opening 44 defined by axial surface 45 concentric about axis X. This opening may be the same size as opening 30. A finished radial concentric surface 46 on the cylinder block adjoins surface 45. A supporting member 47 having axial and radial surfaces adapted to fit closely on surfaces 45 and 46 is mounted and accurately located on the cylinder block, being demountably secured by bolts 48 extending through member 47 and threaded into the cylinder block. Member 47 has an axially extending bearing opening 49 concentric about axis X.

A crankshaft 51 is rotatably supported by member 47. The crankshaft comprises a shaft portion 52 closely fitting but rotatable in opening 49 of member 47, a crank throw portion 53, and a crank pin 54 rigidly fixed to portion 53 and cylindrical and coaxial about another axis Z offset from and parallel to axis X. Crank pin 54 has a free end 55.

This free end extends into a recess 56 in the adjacent side of rotatable valve member 31. This recess is shown (FIG. 7) as elongated with its narrowest width lying on an axis W radial to and intersecting axis X and of a width which provides a close but movable fit with the end 55 of the crank pin. The extra length along the axis W of recess 56 provides ease of assembly.

Figure 3:
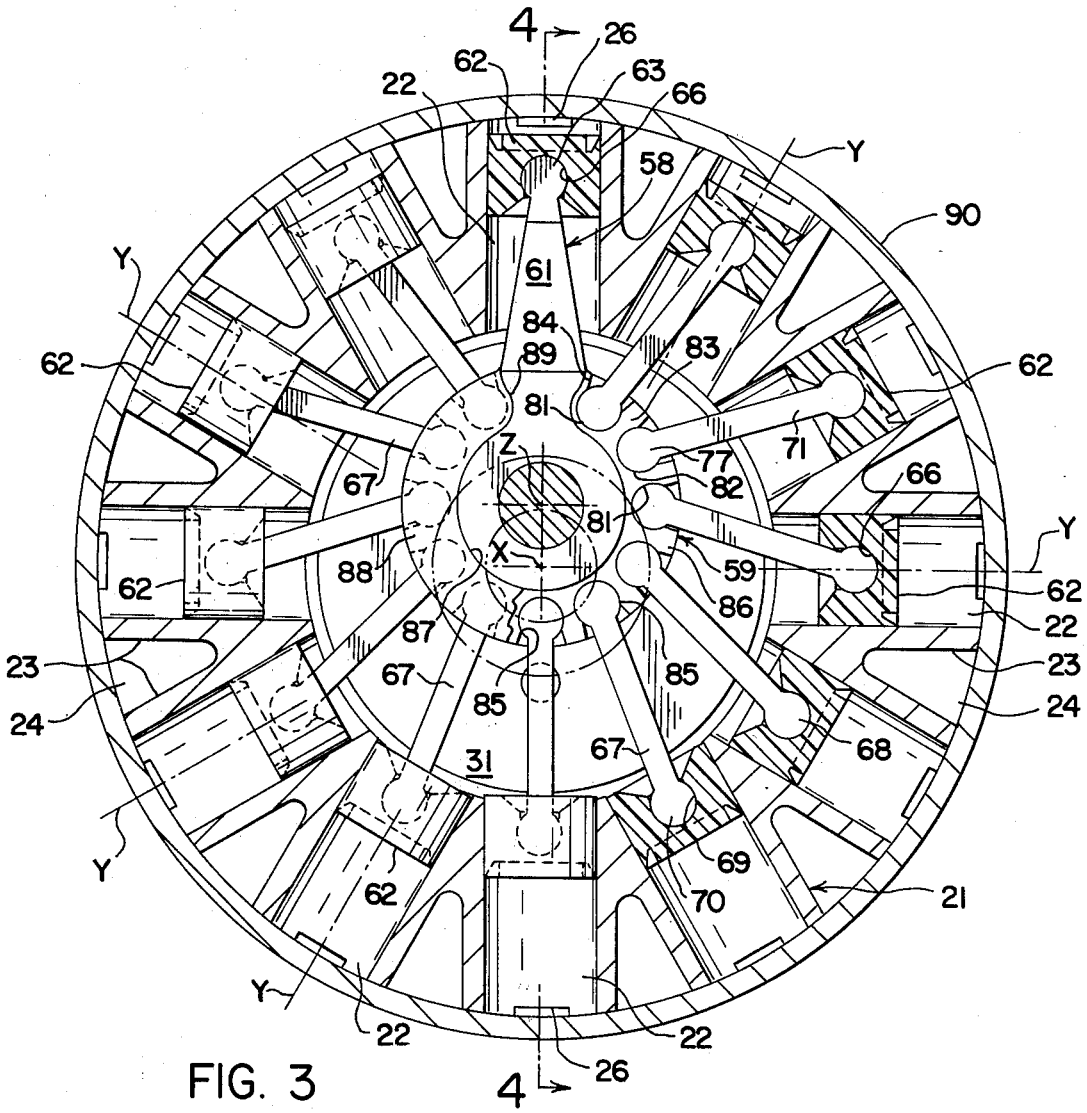
FIG. 3 is a section to a substantially larger scale than that of FIGS. 1 and 2 of a gas powered motor embodying the invention along a line 3—3 of FIG. 4.
Figure 4:
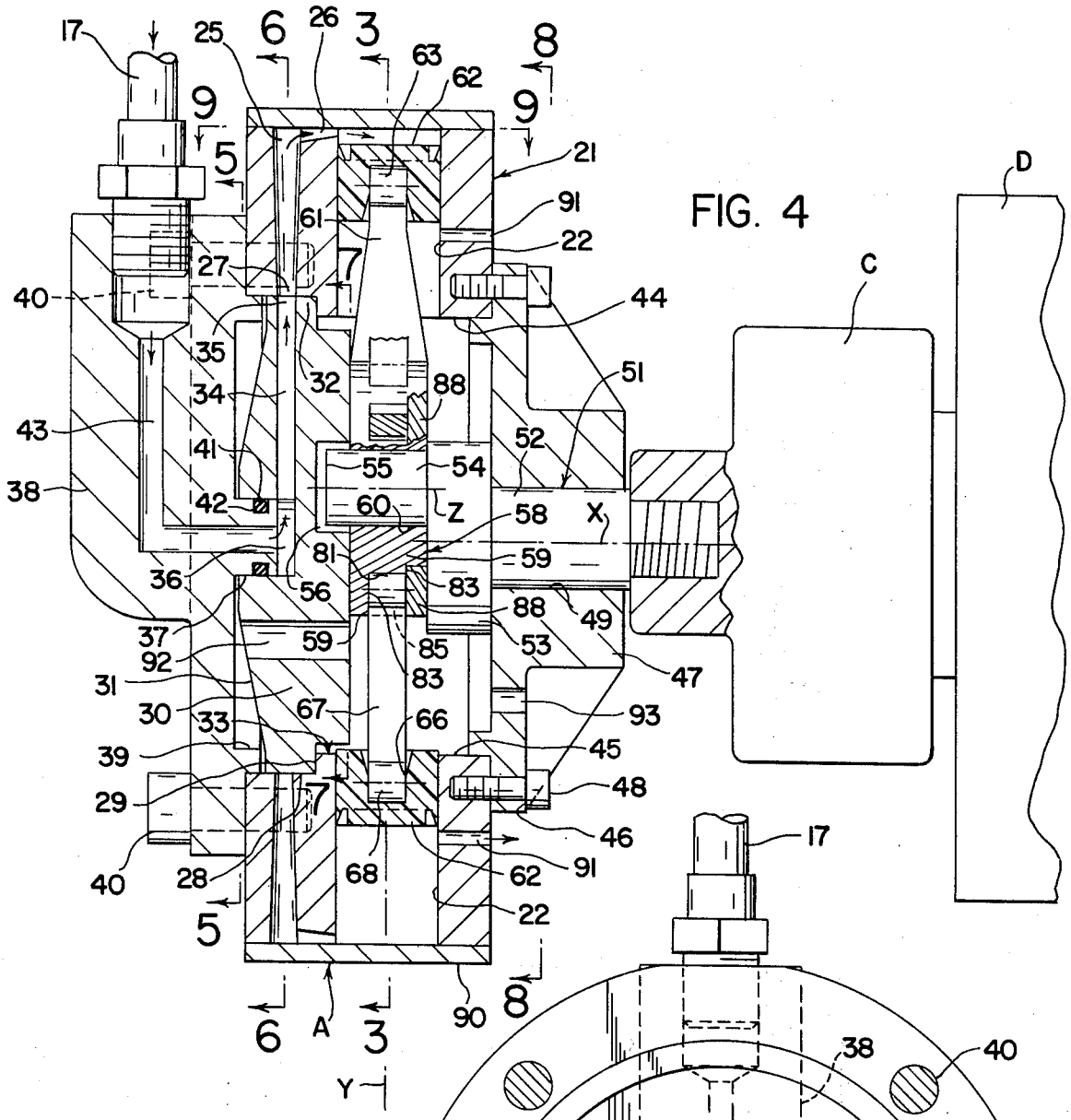
FIG. 4 is a sectional elevation of the engine of FIG. 3, along line 4—4 of FIG. 3 and to the same scale, the engine being shown connected through a clutch to an internal combustion engine of the chain saw of FIG. 2.
Figure 5:
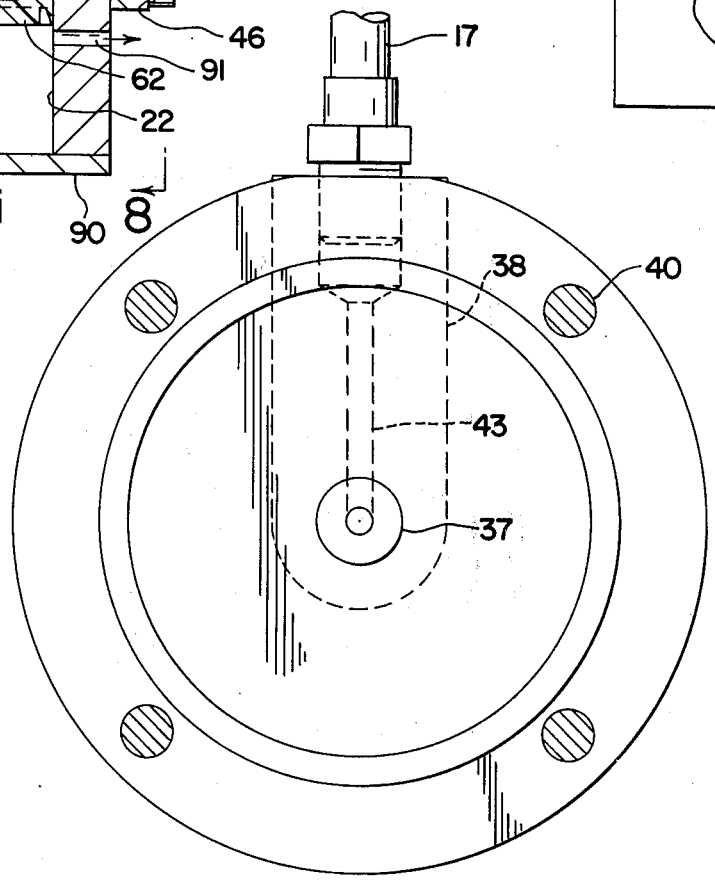
FIG. 5 is a section along 5—5 of FIG. 4 to the same scale.
Figure 6:
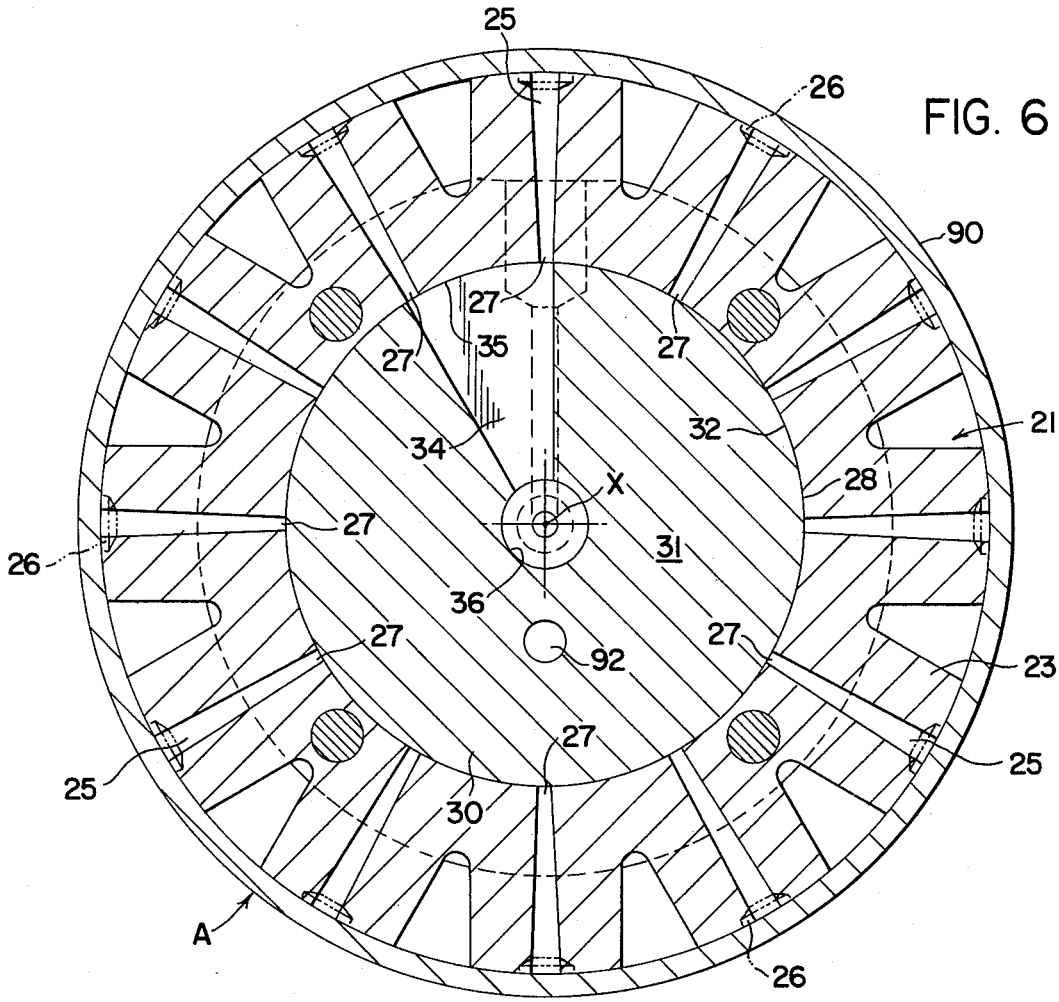
FIG. 6 is a section along line 6—6 of FIG. 4 to the same scale.
Figure 7:
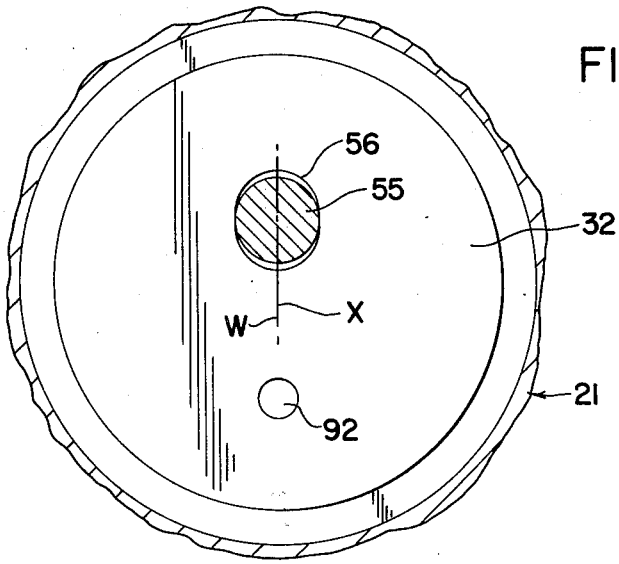
FIG. 7 is a section along line 7—7 of FIG. 4 to the same scale, showing the free end of the crank pin engaging the rotary valve.
Figure 8:
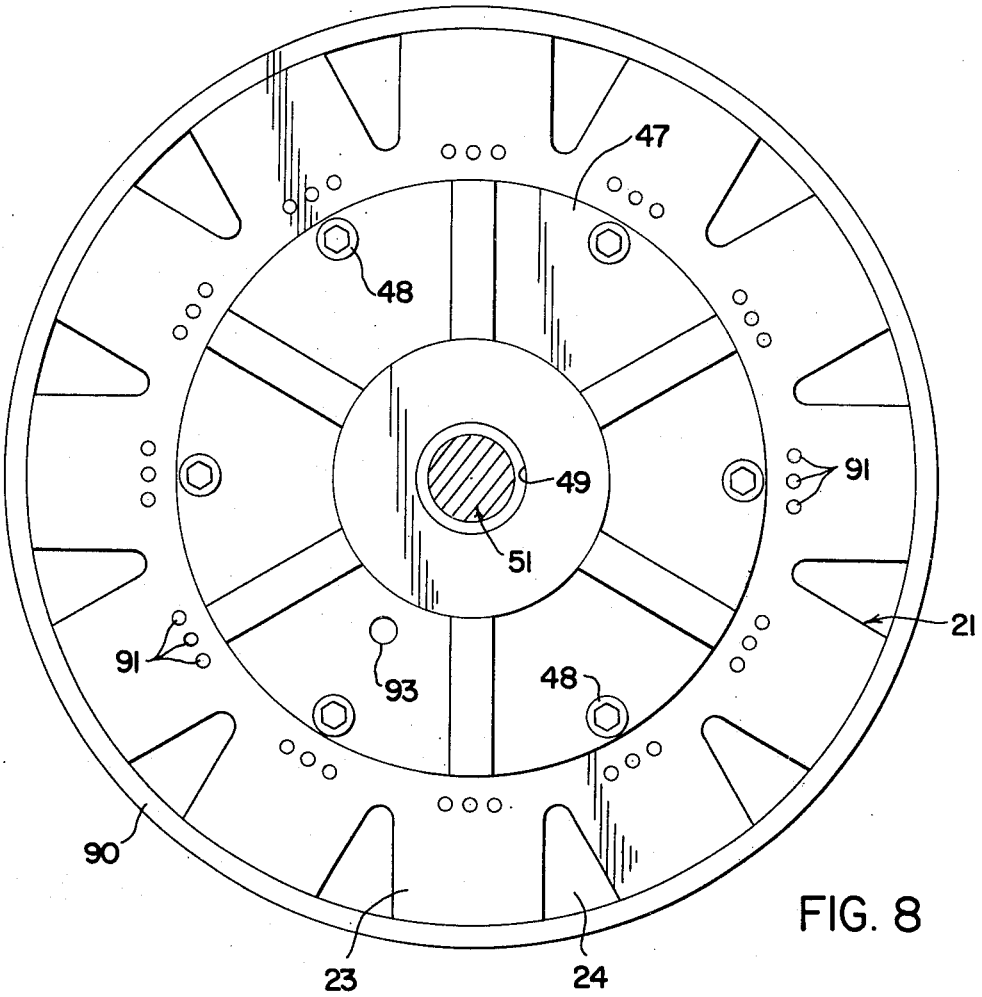
FIG. 8 is a view along line 8—8 of FIG. 4 and to the same scale.
Figure 9:
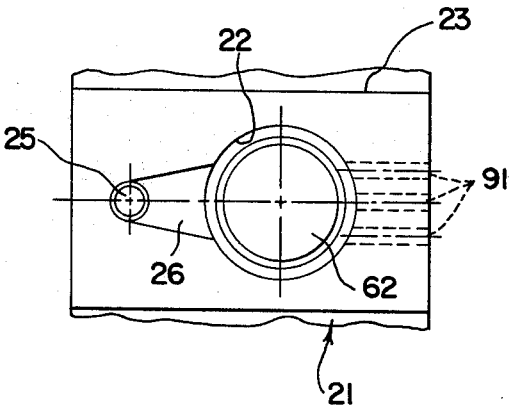
FIG. 9 is a view along line 9—9 of FIG. 4 to the same scale.
Figure 10:
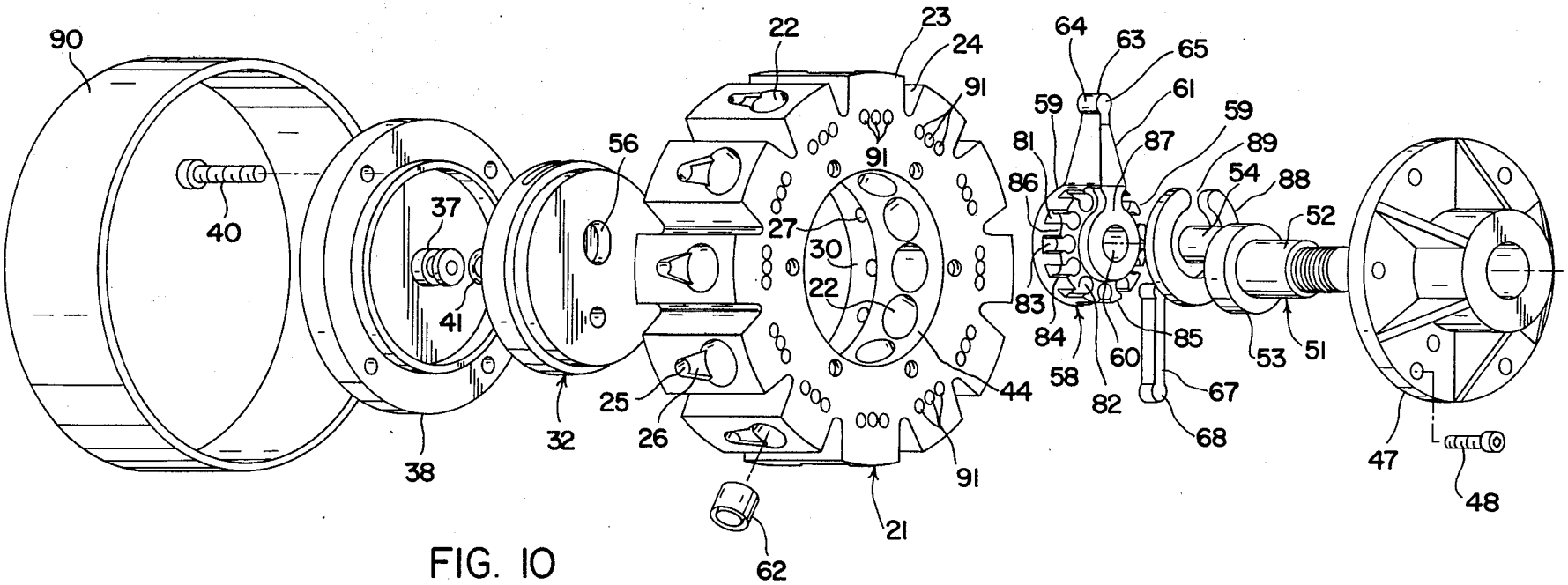
FIG. 10 is an exploded view to a smaller scale of the gas-powered starter engine of FIGS. 1 to 9 inclusive.

Connecting rod mounting means, illustrated in FIGS. 3, 4 and 10 as a master connecting rod member 58, is rotatably mounted on crank pin 54. Member 58 has a hub portion 59 having a bore 60 closely rotatably fitting crank pin 54. The hub portion is sufficiently thick to fit closely but movably between crankshaft portion 53 and valve member 31. Member 58 also includes, rigidly fixed to and preferably formed integrally with hub portion 59, a connecting rod 61 that is pivotally connected to one of the identical pistons 62, one of which is slidably mounted in gas-tight relation in each of cylinders 22. Connecting rod 61 has an outer enlarged free end portion 63 the outer curved surface 64 and end surface 65 of which define a portion of a cylinder with flat ends. Portion 63 is snapped into and held in place in a mating socket 66 in one of the pistons 62.

In the embodiment of FIGS. 1 to 10, however, each of the pistons other than that connected to rod 61, is connected to an individual connecting rod 67 which is pivotally connected to master connecting rod member 58, all connecting rods 67 being identical. Each connecting rod 67 has an outer enlarged free end portion 68 identical in shape with portion 63 of connecting rod 61, with an outer curved surface 69 defining a portion of the cylinder and flat ends 70. The enlarged end portion 68 of each rod 67 is snapped into socket 66 of associated piston 62.

Each piston 62 is formed of a stiff, somewhat resilient material, having good wear resistance when slidably engaged with the metal, such as aluminum, of the wall of the associated cylinder. The material of each piston has such characteristics and its socket 66 is so shaped with re-entrant edge portion 72, that the end portion 63 of rod 61 or the end portion 68 of a rod 67 can be snapped or forced into the socket 66 of the piston during assembly by temporary resilient spreading of the edge portions 72 of the socket, and the rod end thereafter is firmly but pivotally held or clamped in place during operation of the motor, without the necessity of using retaining rings, pivot pins, screws or retaining means other than the mating shapes of the socket opening and ends of the connecting rods, and the characteristics of the material of the piston. Each piston has, adjacent the open end of its socket 66, a recess 73 with inclined walls **73*a*, 73*b* that guides the free end portion of the associated connecting rod into the socket of the piston and facilitates snapping of the connecting rod end into the piston socket during assembly of the motor. Recess 73** also provides clearance for the pivotally moving connecting rod during operation of the motor. An example of material found suitable for the pistons is a synthetic resin material containing molybdenum disulfide.

Each piston 62 also has a circumferential groove 75 which in the embodiment of FIGS. 1 – 16 is located at the piston side subjected to pressurized gas during the working stroke of the piston. The groove is of such shape that it defines on the piston a circumferential thin or feather edge 76 that faces the pressurized gas during the piston working stroke and is deflected by the pressurized gas outwardly toward the wall of the cylinder to form an essentially gas-tight seal with the cylinder wall when pressurized gas drives the piston toward the crankshaft in the working stroke of the piston.

Each connecting rod 67 has at its other or inner end an enlarged free end portion 77 which in the embodiment of FIGS. 1–16 is identical in shape with end portion 68 and has a curved outer surface 78 that forms part of a cylinder with flat ends 79 and is held in a socket 81 (FIGS. 3, 4, 10) formed in the hub portion 59 of the master connecting rod member 58. Each socket 81 has a curved inner surface 82 that mates with and closely fits the curved outer surface 78 of portion 77 of the associated connecting rod 67, an inner flat wall 83 and a flared outer recess portion 84 for rod clearance during motor operation, the socket 81 being shaped with inwardly extending edge portions 85 that retain the end portion 77 of the connecting rod against outward radial movement relative to hub portion 59. Each socket 78 extends and opens into a side wall 86 of hub portion 59, wall 86 being offset inwardly around a central portion 87 of the hub portion. End portions 77 of the connecting rods 67 are prevented from moving axially outwardly from the sockets 81 by a retainer member 88 that is shaped to fit around the central portion 84 and against the side wall 83, and by opening 89, to fit against the sides of the base of rod 61, member 88 also being located between the side wall 86 of hub portions of member 58 and the crank portion 53 of the crank shaft. Member 88 is thus secured against rotational and axial movement relative to hub portion 59, and the connecting rods 67 are firmly pivotally connected to hub member 59 of connecting rod mounting 58 without clamps, pivot pins, screws or other complicated means.

The outer ends of the cylinders are closed by a closure member or ring 90 that is mounted in gas-tight relation on the outer ends of the cylinder portions 23 of the cylinder block 21. This ring, which is shown as metal, may be secured in place by a shrink-fit obtained by heating the ring itself to expand it and then placing it in position on the cylinder block and allowing it to cool to cause it to contract and be securely mounted. If it is later desired to remove the ring for any reason, the ring can then be heated to expand it and then slipped off the cylinder block. Alternately, the ring may be held in place by suitable adhesive, such as an epoxy type cement; this is desirable if the ring or cylinder block or both are formed of non-metallic material. When the ring is in place, it closes and seals the ends of the cylinders and of the radial and transverse conduits 25, 26, and thus insures that all power gas passing through these conduits will pass into the cylinders.

Each cylinder also has one or more openings 91, three in the illustrated embodiment, through which the power gas may be rapidly exhausted to atmosphere when the piston completes its inward stroke toward the crankshaft.

Moreover, closure and supporting members 38 and 47 respectively have openings 92 and 93 opening to the ambient to insure that the interior crankcase portion of the cylinder block will at all times be at atmospheric pressure.

The known clutch C is suitably rigidly mounted on the end of crankshaft 51 as by a threaded connection shown in FIG. 4.

Because of the design of the illustrated embodiment of the invention, it may be readily and very economically manufactured and assembled. Thus, the connecting rods may be molded, or since they are flat, stamped from metal or other suitable material. The cylinder block 21, valve member 31, closure members 38 and 47, and member 58 may be die cast of metal or molded of other suitable material, with only little required machining. The pistons 62 may be readily molded or suitable material, and the crankshaft may be economically manufactured because of its very simple construction utilizing only a single crank throw portion 53.

A preferred method of assembly is as follows, assuming that all of the parts are disassembled as shown in FIG. 10.

The connecting rods 67 without pistons 62 attached, have their ends 77 inserted in the sockets 81 in the hub portion of master connecting rod member 58. Retainer member 88 is then placed on the central portion 87 of the hub portion 59 of the master connecting rod. This subassembly is then mounted by bore 60 on the crank pin 54 of the crankshaft. Thereafter this subassembly is manipulated so that all connecting rods 67 and connecting rod 61 are inserted into the cylinders, one to each cylinder. The supporting member 47 then is slid over the shaft portion of the crankshaft, and bolted in place, thus accurately locating the crankshaft and keeping the connecting rods in their respective cylinders.

Pistons 67 then are inserted into the cylinders from their open ends, and each piston is pushed down and snapped over the end of the enlarged portion of its appropriate connecting rod, each connecting rod being manipulated to leate it if necessary, from the opening 30 at the other side of the cylinder block. The flared recesses 73 of the pistons aid in guiding the enlarged ends of the connecting rods into alignment with the piston sockets 66 to that forces on the pistons will snap the end of the connecting rods into the sockets.

Thereafter valve member 31 is placed in opening 30 and rotated if necessary until its recess 56 engages the free end 55 of the crank pin 54. The valve member then can be located axially by contact of its radial surface 33 with radial surface 29 of the cylinder block.

Next, the closure member 38 is mounted with its hub portion 37 protruding into the central recess 36 in the rotary valve member, and is axially located in the proper position, after which bolts 41 are inserted to bolt it in place.

Thereafter, the closure ring 90 may be mounted as indicated above. The engine is then assembled ready for use.

In another method of assembly, pistons 62 are first snapped onto the ends of the individual connecting rods 67 which at this point are not connected to the master connecting rod member 58. These pistons are then slid into their selected cylinders from the crank case or inner ends of the cylinders. The piston 62 connected to the master connecting rod member 58 is also inserted into its selected cylinder either before or after insertion of the other pistons. The inner ends 77 of the individual connecting rods 67 are then inserted into the sockets 81 of the member 58. Retainer member 88 is then put in place, the crank pin 54 is slid through the opening 60 of member 58, and the supporting member 47 is slid over the free end of the shaft portion 52 of the crankshaft onto the shaft portion and bolted in place. The remainder of the engine can be assembled as described above. This procedure is particularly well adapted to a motor in which the outermost ends of the cylinders are not open prior to assembly.

Figure 2:
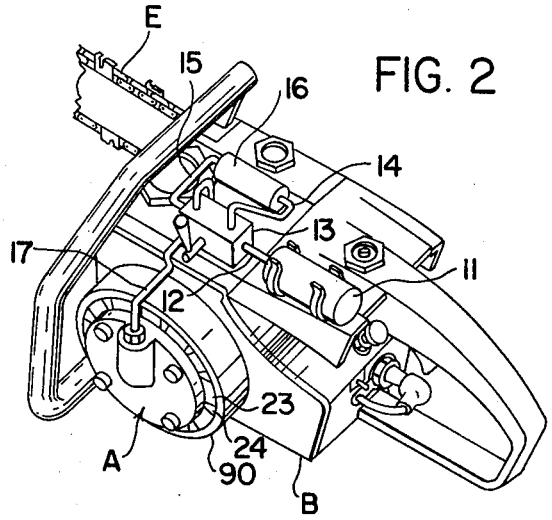
FIG. 2 is a perspective view to a smaller scale showing a chain saw of a known type having a known internal combustion engine to drive the saw, which chain saw embodies a starter motor embodying the invention for starting the internal combustion engine.
Figure 17:
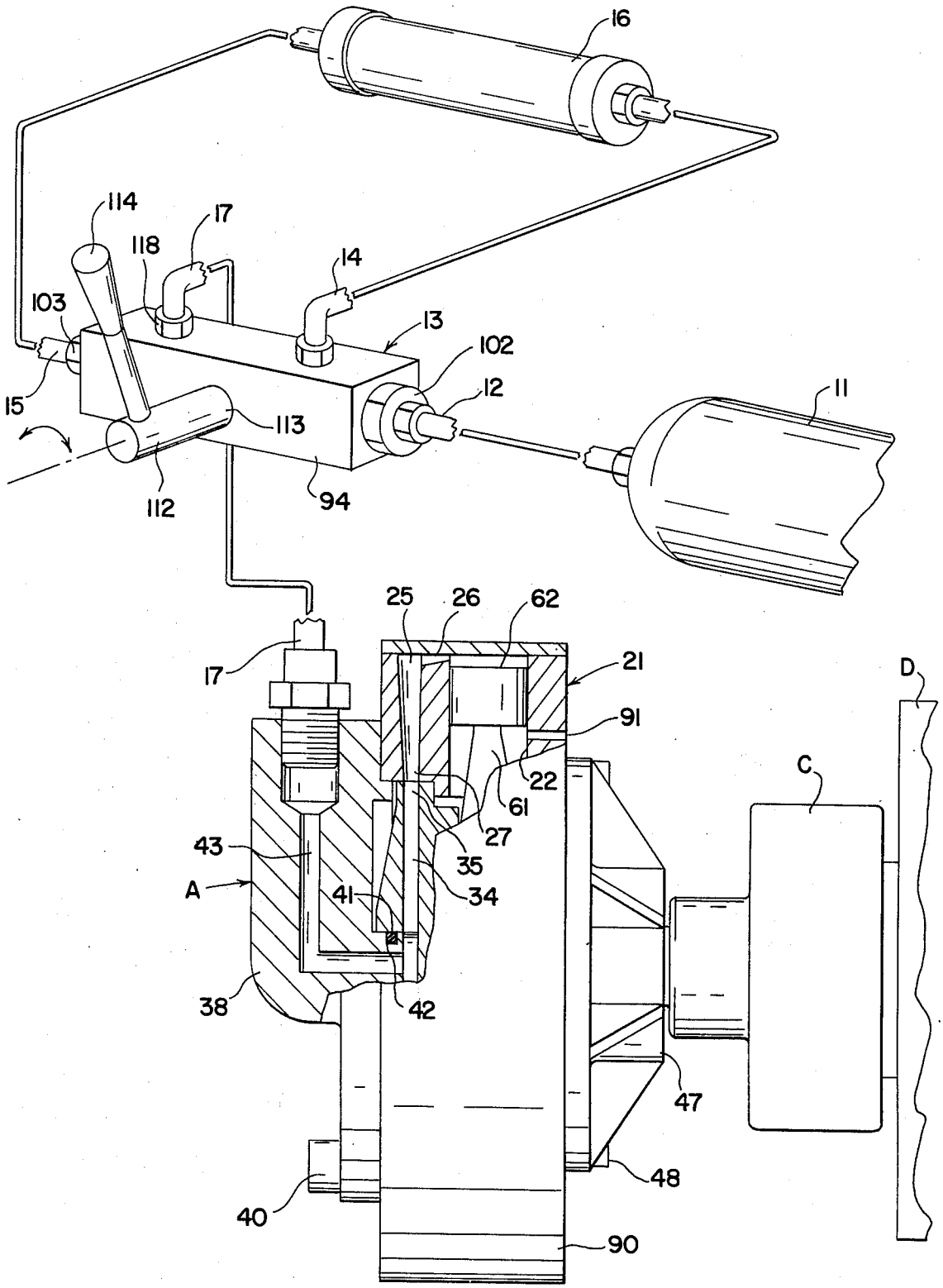
FIG. 17 is a diagrammatic view of a power gas control system embodying the invention shown as used with the above described motor.
Figure 18:
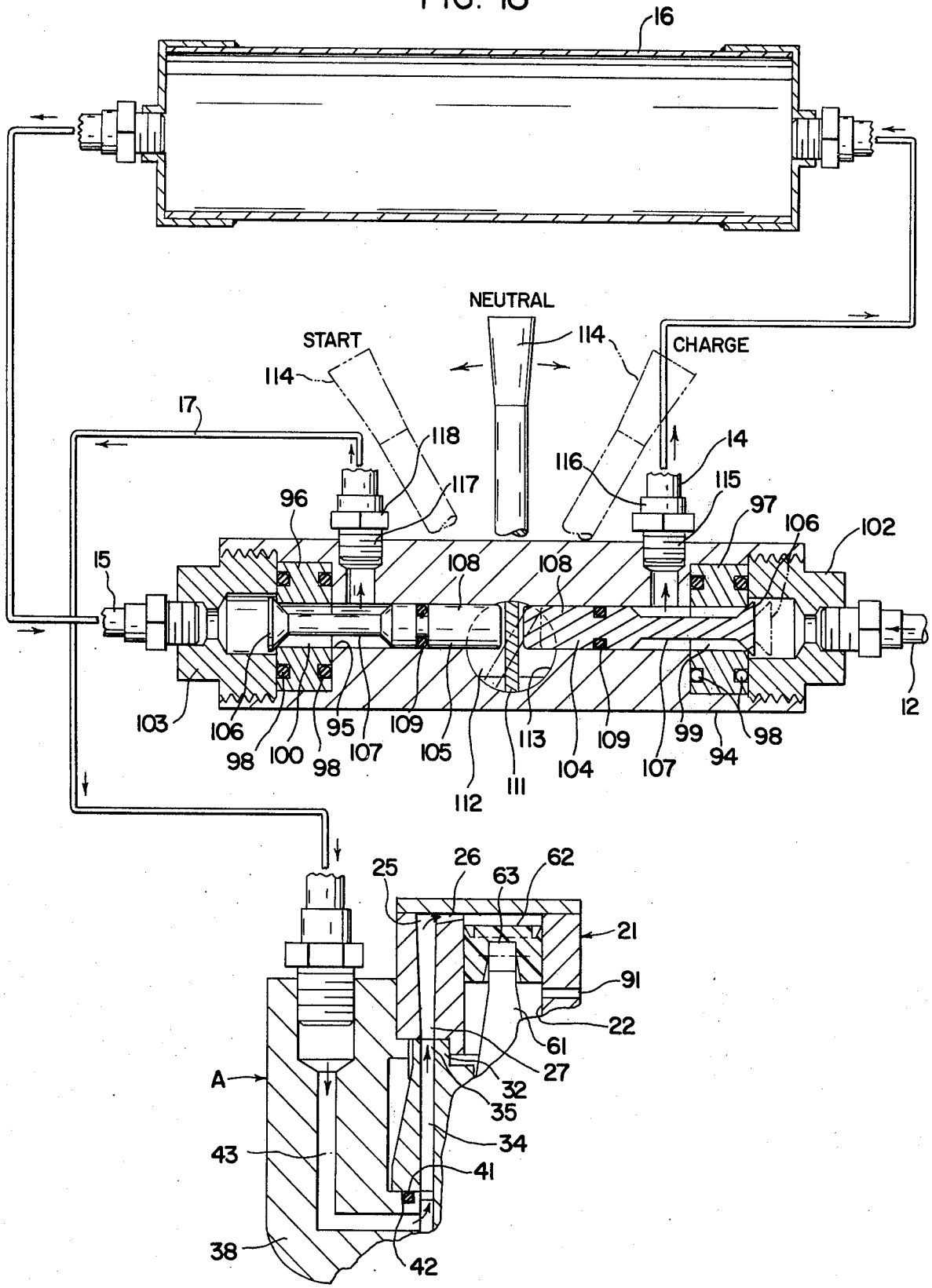
FIG. 18 is a sectional elevation through the control valve of FIG. 17.

In the gas control system shown in FIGS. 2, 17, 18, conduit 12 connects a suitable source of pressurized gas 11 with vale unit 13. When released by the valve unit, gas passes through conduit 14 to a plenum chamber 16 to hold a predetermined volume of gas to operate motor A. When released by the valve unit, pressurized gas passes through conduit 15 to the valve unit which permits its discharge through conduit 17 to motor A. The plenum chamber, of which two other embodiments will be discussed later, insures that on a starting cycle there is used only a predetermined volume of power gas calculated to rotate the crankshaft of motor A sufficiently to provide desired starting action on an internal combustion engine D of a powered chain saw, lawn mower or other implement, without using excess gas. This system provides great economy of use of the power gas.

As shown in FIG. 18, the valve unit comprises a body 94, shown of generally square cross section, which has a bore 95 of generally circular cross section extending longitudinally through it. The ends of the body are recessed to provide space for valve seats 96, 97 which may be made of metal or suitable synthetic resin material, preferably with O-rings 98 disposed in grooves in the valve seats to insure against escape of gas. The valve seats respectively have openings 99, 100 constituting prolongations of bore 95 in the housing. The valve seats are respectively held in place by adapter members 102 and 103 threaded into the end of the housing to bear against the valve seat to hold it in place. Adapter member 102 carries a threaded connector for conduit 12, and member 103 carries connector for conduit 15.

Two oppositely extending valve stems 104 and 105 are located in bore 95 of the housing and the valve seat openings, each valve stem having a valve head 106 adapted to seat in gas-tight relation against its associated valve seat, and connected by a neck portion 107 to a piston 108 of the valve stem that closely fits in the bore 95 and is sealed to it by an O-ring 109 in a groove in the piston portion.

Each valve stem is adapted to be moved in a direction which lifts the valve head from the valve seat by a vane 111 mounted on one end of a valve rotor 112 journaled in an opening 113 in the housing 94 extending transversely of the bore 95, the valve rotor having a lever type handle 114 rigidly fixed to its other and free end, to permit the rotor vane to be turned in either direction.

The valve body also has an opening 115, communicating with bore 95 at the neck portion of the valve stem 104, in which is threaded a connector 116 for tube 14. It also has another opening 117 communicating with bore 95 at the neck portion of the other valve stem 105, in which is threaded a connector 118 for conduit 17 extending to motor A.

It is apparent that when the handle 114 is partially turned clockwise in FIGS. 17 and 18, the vane 111 will move the valve stem 104 outwardly so its valve head 106 will lift from its seat 96, as shown in broken lines in FIG. 18, permitting gas under pressure to pass from storage tank 11 past the neck portion 107 of the stem into the plenum chamber 16 to fill it with gas under the pressure of the storage tank. When the handle is moved to its center position, the vane 111 is in the centered position shown in full lines in FIGS. 17 and 18, the gas in conduit 12 causes the valve head of valve stem 104 to seat against valve seat 96 and cut off the flow of gas from the storage tank. When the handle 114 is partially turned clockwise, the vane 111 pushes valve stem 105 outwardly and causes its valve head to lift from its seat 97 as shown in broken lines in FIG. 18, permitting gas under pressure to pass through conduit 15 from the plenum chamber into the end of the valve unit, past the valve head and neck portion of the valve and through conduit 17 to motor A. This delivers to the motor an amount of power gas determined by the volume of the plenum chamber.

Figure 19:
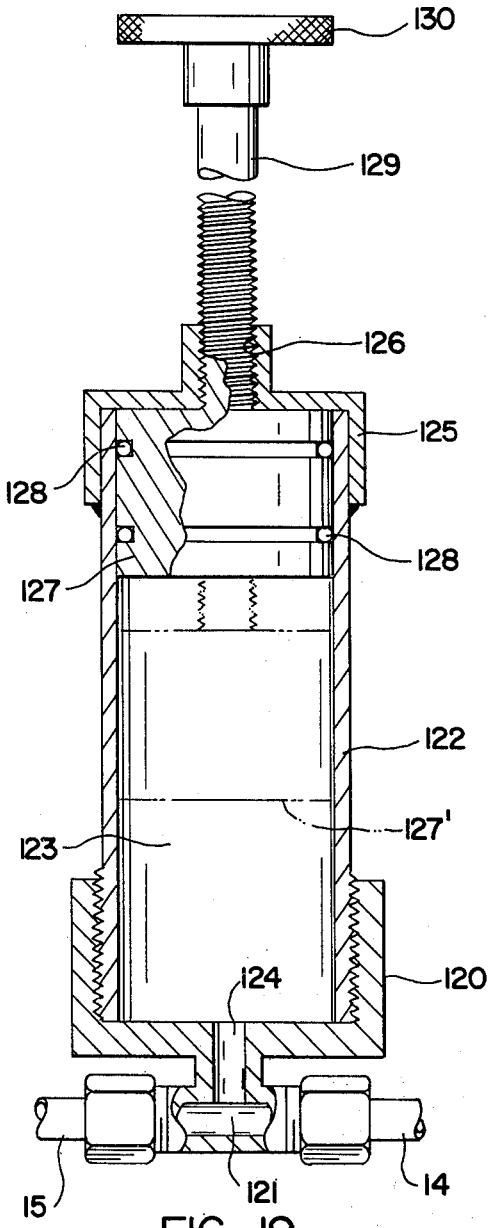
FIG. 19 is a section through a plenum chamber that may be used in the system of FIG. 19.

The plenum chamber may, if desired, be a variable volume plenum chamber such as shown in FIG. 19. This plenum chamber comprises a base 120 having a passage 121 connected to the conduits 14 and 15 communicating with valve unit 13. A cylinder member 122 is threaded at one end gas-tightly into base 120; its interior 123 communicates through passage 124. Member 122 is also fixed at its other end gas-tightly to an end member 125 having a central internally threaded opening 126. A piston 127 is slidably mounted in cylinder member 123, O-rings 128 being provided to insure gas tightness; it is connected to a piston rod 129 having external threads engaging the internal threads of member 125. By manual rotation of handle 130 on the piston rod, the piston can be moved axially of the cylinder to adjust the volume of the plenum chamber, as shown in broken lines 127, the threaded connection between the piston end and member 125 holding the piston in its adjusted position. Reduction of the volume is advantageous as a gas economy measure when the starter motor is being used to start a hot internal combustion engine, which is easier to start than a cold one. For example, the internal combustion engine of an implement such as a chain saw or lawn mower, which in the course of use is started and stopped frequently, will require substantially less power gas for starting after the internal combustion engine is hot from prior use, than on the initial starting. Therefore with a variable volume plenum chamber such as that described above, the larger volume of gas can be used on the initial cold start of the internal combustion engine, and thereafter a smaller volume while the internal combustion engine is hot.

Figure 20:
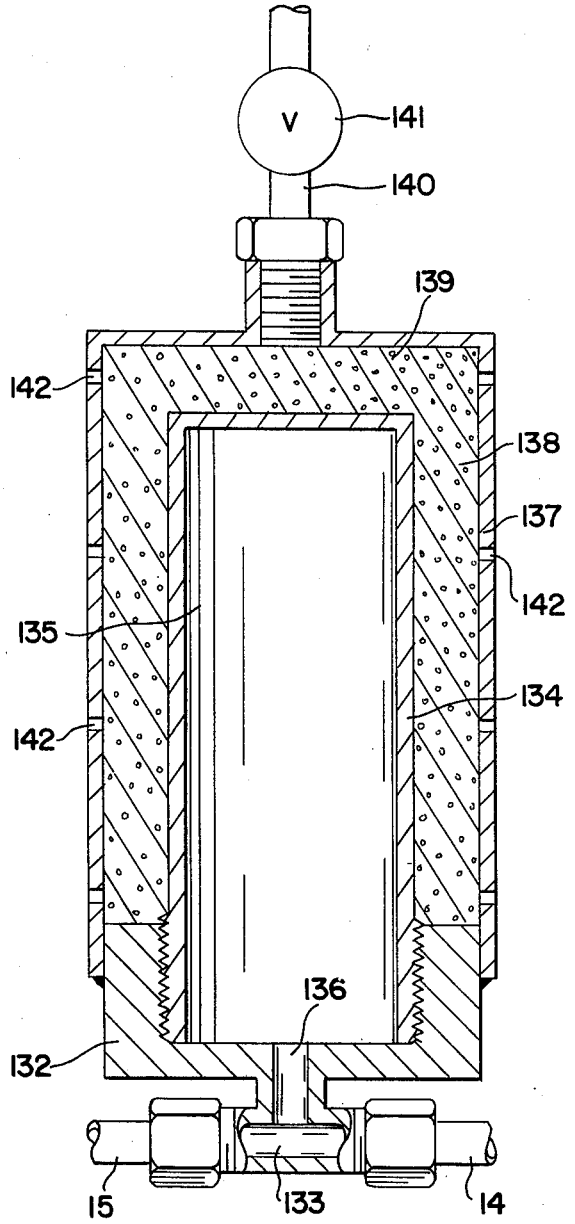
FIG. 20 is a section through another plenum chamber that may be used in the system of FIG. 17.

Another type of plenum chamber that can be used is shown in FIG. 20. This plenum chamber is adapted to be heated to heat the pressurized gas so that a smaller volume of gas will be used on rotating the gas powered motor. This plenum chamber comprises a base member 132 having a passage 133 to which are connected the conduits 14 and 15 communicating with valve unit 13. A pressure resistant housing 134, the interior 135 of which is closed except for the gas passage 136 is threaded gas-tightly into communicating with passage 133, of base member 132.

An outer housing or enclosure shell 137 is mounted on base member 132 to surround housing 134 to provide a substantially enclosed space 138 between housing 134 and 137. This space contains a suitable catalytic material 139 such as platinum sponge-aluminum oxide catalyst, which will cause combustion of a suitable hydrocarbon fuel material such as butane gas, of which a suitable amount is introduced into the space 138 from a suitable source such as conduit 140 connected to a small commercially available tank of fuel, not shown, through valve 141. Suitable openings 142 are provided in shell 137 to introduce air containing oxygen for combustion purposes.

The volume of the interior 135 of housing 134 can be such that when heated by hydrocarbon fuel introduced into the catalyst the pressurized power gas in the interior 135 will be heated, and the volume and pressure of the heated power gas will be sufficient to provide the desired rotation of motor A to effect starting of engine D.

Of course, a combination of features of the two illustrated plenum chambers may be used to provide a variable volume plenum chamber adapted to be heated.

Figure 21:
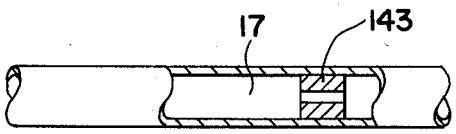
FIG. 21 is a detail showing gas flow restricting means in a conduit to the motor.

Furthermore, if desired to further increase economy of gas consumption, suitable flow-restricting means such as apertured ring 143 (FIG. 21) can be provided to reduce the gas passage area of conduit 17 extending between valve unit 13 and the motor A.

Various modifications may be made in the apparatus of the invention discussed above.

Figure 22:
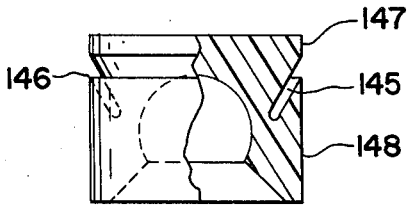
FIG. 22 is a view, partly in section, of another piston embodiment.

As shown in FIG. 22 the pistons may be made with a circumferential slot 145 that extends inwardly and downwardly away from the high pressure side of the piston, to provide a feather edge 146 between the top and bottom edges of the piston, rather than at one edge of the piston as previously described. This feather edge also deflects outwardly to provide a gas seal. Moreover, in this design there are cylindrical portions 147 and 148 on both sides of the slot which can aid in keeping the piston aligned in the cylinder.

FIGS. 23 to 28 inclusive disclose an alternative connecting rod mounting means, alternative designs of individual connecting rods, and an alternative design of a piston, which are shown as designed for use in the motor A described previously.

The connecting rod mounting means takes the form of a master connecting rod member 150 (FIGS. 23, 24) having a central hub portion 151 having bore 152 concentric about axis Z adapted to receive crank pin 54 of crankshaft 51, to which hub is affixed a rigid connecting rod 153. This connecting rod has at its outer end an enlarged portion 154 the outer surface of which defines a major portion of a sphere. The hub portion includes two identical flanges 155 separated by a space 156 that extends around the major portion of the hub portion except for the portion that is fixed to the rigid connecting rod 153.

A plurality of pairs of identically sized aligned openings 157 in flanges 155 are equiangularly and equidistantly spaced around the axis Z except for omission of a pair of openings along a plane extending through the center of the spherical end of the master connecting rod and the axis Z.

Each individual connecting rod 158 (FIGS. 25 and 26) has a shaft portion 159 and enlarged end portions 160 and 161 each of which is a major portion of a sphere. End portion 160 is identical in size with the spherical portion 154 of the connecting rod 153, and end portion 161 as shown, may also be identical in size and shape. As shown in FIGS. 23, 24 the spherical enlarged portion 161 at one end of each connecting rod 158 is snapped into a pair of aligned openings 157 in the flanges 155, either by resilience of the material of which the flanges are formed, or of the material of which the end portions 161 of the connecting rods 158 are formed or by resilience of both the end portions 161 and the flanges 155. The connecting rods 158 one of which is provided for each pair of aligned openings 157, are thus firmly pivotally connected to the master connecting rod member so that they will not disconnect during operation of the motor.

The outer spherical unconnected end 154 or 160 of each of the connecting rods 153 and 158 is adapted to be snapped into a mating socket 164 in one of the pistons 165 (FIGS. 27, 28), each of which pistons has a circumferential slot 75 defining a circumferential sealing edge 76 as previously described. The socket 164 is shaped to constitute a major portion of a sphere, having an inwardly extending lip 166 between the socket portion and a flared circular frustoconical recess 167. This lip expands to permit the spherical end of the connecting rod to be snapped into the socket, and then contracts, and thus aids in holding or clamping the spherican end portion of the associated connecting rod in the socket while permitting pivotal movement of the rod relative to the piston. Each of the sockets and the end of the connecting rod that goes in the socket is so shaped that the end portion of the connecting rod can be snapped into the socket and held there so that the piston will not detach from the connecting rod during operation of the engine. In the illustrated embodiment the piston of FIGS. 27 and 28 is formed of a stiff resilient non-metallic material which will permit this action to occur.

The master connecting rod member 150 and its associated individual connecting rods 158, may be formed into a subassembly without the pistons, and this subassembly then placed in the cylinder block during assembly of the motor, with the connecting rods extending into the cylinders, after which the pistons are pushed into the cylinders and engaged with the outer ends of the connecting rods, in a manner similar to that previously described.

Various other modifications may be made in the illustrated embodiments. Thus, while the pistons have been disclosed above as formed of stiff non-metallic material which can be deformed sufficiently to permit the ends of metallic connecting rods to be snapped into the sockets in the pistons but resilient enough to firmly pivotally hold the ends of the rods in the sockets of the piston during operation of the motor, the pistons can be made of metal and the piston rods can have at least their end portions made of stiff resilient material which permits them to be snapped into the sockets of the pistons and held therein; or both the piston socket portions and end portions of the connecting rods can be made of metallic, or non-metallic material provided that the above described snap-in and firm pivotal holding actions after snap-in can occur.

Moreover, while the cylinder block has been disclosed as being made of metal, it may be made of other materials, such as suitable synthetic resins. Similarly, other parts of the apparatus shown as made of metal may be made of other suitable synthetic resins.

Furthermore, while the motor has been shown with the cylinders radially arranged with the axes of the cylinders all lying in the same plane, other arrangements of cylinders may be provided.

Other valve structures other than those indicated may be used.

While the invention has been disclosed in connection with pressurized carbon dioxide gas as the power gas, other pressurized gases may be used such as nitrogen or other gases which do not undergo combustion in the cylinders of the engine.

The present invention thus provides a motor particularly advantageous for starting a small internal combustion engine of a power implement, which motor may be economically manufactured and assembled, which is durable, and which provides safe and effective means of starting internal combustion engines. Moreover, the gas control system disclosed makes possible the economical use of power gas.

A motor embodying the invention having cylinders arranged radially around a crankshaft, as disclosed above provides exceptional economy in usage of power gas in driving the motor, which is important for starting purposes. Such arrangement of the cylinders and their pistons makes it possible to reduce the number of crankshaft bearings and attendant bearing friction that would otherwise be necessary in a motor in which the cylinders are arranged in a line along the crankshaft; in the motor disclosed above there is only one crankshaft bearing so that crankshaft bearing friction may be held to a minimum. Moreover, in the motor of the invention, the inlet gas passage means can be simple and short as disclosed, making possible minimal power loss due to friction of the gas on its way to the cylinders to drive the pistons. When such a motor is used in combination with the plenum chamber as disclosed for temporarily storing a predetermined charge of power gas for starting purposes, great economy in gas consumption is possible.

With an ordinary commercially available cylinder of liquified carbon dioxide gas about 8 inches long and 1⅛ inches in diameter, it has been found possible to start internal combustion engines of up to 4 horsepower of powered chain saws or lawn mowers, for more than one hundred times before the gas supply was exhausted, by use of a starter motor embodying the invention including 12 radially arranged cylinders approximately ½ inch in diameter with pistons of approximately ½ inch stroke, which motor was directly coupled to the crankshaft of the engine, a plenum chamber being used as described above to isolate a charge of from ¾ to 1½ grams of gas for operating the motor on each starting operation. Internal combustion engines of 10 and 40 horsepower have been started by starting motors embodying the invention.

Various advantages and modifications apparent to those skilled in the art in addition to those indicated above may be made in the apparatus disclosed above, the changes may be made with respect to the features disclosed, provided that the elements set forth in any of the following claims or the equivalents of such be employed.

What is claimed is:

1. A motor adapted to be powered by pressurized gas and suitable for use as a starter motor for small internal combustion engines comprising housing means having an axis and a plurality of cylinders disposed generally radially around said axis; crank means having a shaft portion supported from said housing means for rotation about said axis, and having a crank pin portion offset from said axis of said housing means; pistons mounted in said cylinders, said pistons being formed of stiff resilient material, each of said pistons having a socket opening therein; connecting rod mounting means rotatably mounted on said crank pin portion, said connecting rod mounting means having a plurality of openings therein corresponding to a plurality of said cylinders; a plurality of identical connecting rods, each of said connecting rods being symmetrical about an axis extending perpendicular to the longitudinal axis thereof and each having a first enlarged end portion that is held in a socket of one of said pistons, said first enlarged end portion and the piston socket in which it is held being shaped so that due to the resilience of said material of which said piston is formed said first enlarged end portion of said connecting rod may be snapped into said socket and thereafter pivotally but firmly held in said socket in such manner that no substantial movement of the connecting rod with respect to the piston in directions parallel to the axis of the piston can take place during operation of the engine, said connecting rod having at its other end a second enlarged portion identical to said first enlarged end portion pivotally but firmly connected to said connecting rod mounting means solely by the shape of said second enlarged portion and of the shape of the opening in said connecting rod mounting means in which it is disposed without use of a pivot pin or the like.

2. The apparatus of claim 1 in which said connecting rod mounting means has a plurality of said openings in a side of said connecting rod mounting means, each of said openings having a neck portion extending generally radially to the axial exterior of said connecting rod mounting means, said neck portion being narrower than a portion of the opening radially inwardly of said connecting rod means, and in which said second enlarged end portion on each of a plurality of connecting rods is shaped to be inserted in one of said openings from the side of said connecting rod mounting means so that said connecting rod extends through said neck portion to a piston, said second enlarged portion of said piston rod and its cooperating opening in said connecting rod mounting means being shaped so that said second end portion of said connecting rod is pivotally but firmly held in said connecting rod mounting means; and means engaging the side of said connecting rod mounting means having said openings to locate said second enlarged end portions against movement axially of said connecting rod mounting means out of said openings in said connecting rod mounting means.

3. The apparatus of claim 1 in which said second enlarged ends of said connecting rods are snapped into said openings in said connecting rod mounting means and held therein solely by the resilience of the material of at least one of said connecting rod mounting means and said second enlarged end portion of said connecting rod.

4. The apparatus of claim 1 in which each of said connecting rods has two generally parallel flat sides, and in which both enlarged end portions of said connecting rods normal to said flat sides generally define portions of circular cylinders.

5. The apparatus of claim 3 in which each enlarged end portion of each of said connecting rods is the major portion of a sphere.

6. The apparatus of claim 1 comprising unitary pistons each having a narrow circumferential slot having an inclined wall defining a thin edge of said piston extending in the direction from which pressurized gas is supplied to said cylinder so that the pressurized gas forces said thin edge outwardly against the cylinder wall to form a seal.

7. The apparatus of claim 1 in which said housing, said crank means, and said connecting rods are formed of metal.

8. The apparatus of claim 1 in which said cylinders are arranged with their axes in a plane extending normal to said axis of said housing means, and in which said connecting rod mounting means has fixed thereon a connecting rod with an enlarged outer end portion that is pivotally but firmly held in a socket of one of said pistons, the shape of said outer end portion being such that due to the resilience of said material of which said piston is formed said outer end portion of said fixed connecting rod may be snapped into said socket and firmly but pivotally held therein during operation of the engine.

9. The apparatus of claim 1 in which said connecting rod mounting means are fixed thereon a connecting rod with an enlarged outer end portion that is pivotally but firmly held in a socket of one of said pistons, the shape of said outer end portion being such that due to the resilience of said material of which said piston is formed said outer end portion of said fixed connecting rod may be snapped into said socket and firmly but pivotally held therein during operation of the engine.

10. A motor adapted to be powered by pressurized gas and suitable for use as a starter motor for small internal combustion engines comprising housing means having an axis and a plurality of cylinders disposed generally radially around said axis; crank means having a shaft portion supported from said housing means for rotation about said axis, and having a crank pin portion offset from said axis of said housing means; pistons mounted in said cylinders, said pistons being integrally formed to stiff resilient non-metallic material, each of said pistons having a socket opening therein; connecting rod mounting means rotatably mounted on said crank pin portion, said connecting rod mounting means having a plurality of openings therein corresponding to a plurality of said cylinders; a plurality of identical connecting rods, each having a first enlarged end portion that is held in a socket of one of said pistons, said first enlarged end portion and the piston socket in which it is held being shaped so that due to the resilience of said material of which said piston is formed said first enlarged end portion of said connecting rod may be snapped into said socket and thereafter pivotally but firmly held in said socket in such manner that no substantial movement of the connecting rod with respect to the piston in directions parallel to the axis of the piston can take place during operation of the engine, said connecting rod having at its other end a second enlarged portion pivotally but firmly connected to said connecting rod mounting means solely by the shape of said second enlarged portion and the shape of the opening in said connecting rod mounting means in which it is disposed without use of a pivot pin or the like, each of said connecting rods having two generally parallel flat sides and each enlarged end portion normal to said flat sides defining portions of circular cylinders.

* * * * *

UNITED STATES PATENT AND TRADEMARK OFFICE

CERTIFICATE OF CORRECTION

PATENT NO. : 3,981,229

DATED : September 21, 1976

INVENTOR(S) : John H. Breisch and William L. Brown, 4th

It is certified that error appears in the above-identified patent and that said Letters Patent are hereby corrected as shown below:

Column 1, line 9, for "Aug. 23, filed Aug." substitute --filed Aug. 23, 1971,--.

Column 2, line 54, after "member" change "of" to --for--.

Column 4, line 22, start a new paragraph with "FIG. 18",
line 35, change "and" to --end--,
line 57, change "and" to --the--.

Column 8, line 6, change "or" to --of--,
line 35, change "to" to --so--.

Column 9, line 3, change "vale" to --valve--.

Column 15, line 10, change "are" to --has--,
line 27, change "to" to --of--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*